United States Patent [19]

Keith et al.

[11] Patent Number: 4,794,740

[45] Date of Patent: Jan. 3, 1989

[54] COMBINATION PEDESTAL AND VACUUM SYSTEM

[75] Inventors: Malcolm E. Keith, West Chicago; Michael P. Cayley, South Barrington, both of Ill.

[73] Assignee: Midaco Corporation, Elk Grove Village, Ill.

[21] Appl. No.: 88,700

[22] Filed: Aug. 24, 1987

[51] Int. Cl.[4] ..... B24B 55/06

[52] U.S. Cl. ..... 51/273; 51/166 R

[58] Field of Search ..... 51/268, 273, 166 R, 51/166 FB

[56] References Cited

U.S. PATENT DOCUMENTS

| | | | |
|---|---|---|---|
| 1,177,342 | 3/1916 | Leiman et al. | 51/273 |
| 1,528,439 | 3/1925 | Leiman | 51/273 |
| 2,512,930 | 6/1950 | Gilmore | 51/273 |
| 4,578,907 | 4/1986 | Cayley | 51/268 |

*Primary Examiner*—Roscoe V. Parker

*Attorney, Agent, or Firm*—Hill, Van Santen, Steadman & Simpson

[57] ABSTRACT

A combination and pedestal and vacuum system as, for example, for grinder wheels wherein a pedestal serves as a support for one or more grinder wheels and the pedestal is formed with two enclosures, one of which a blower and motor are mounted so as to create a suction and the other forming a container in which a vacuum bag is mounted and which communicates with the blower so as to suck dust, ground material and other materials from the vicinity of the grinding wheel into the vacuum bag. The two compartments are connected so that the blower creates a suction in the compartment in which the vacuum bag is mounted. The compartment in which the vacuum bag is mounted has a sealed door which allows the vacuum bag to be removed and replaced with a new bag. The suction to the vacuum bag may be provided with a hose that connects to an outlet from the guard of the grinder or it might be attached to a different position on the grinder with a suitable bracket.

3 Claims, 1 Drawing Sheet

COMBINATION PEDESTAL AND VACUUM SYSTEM

BACKGROUND OF THE INVENTION

1. Field of the Invention

This invention relates in general to grinding machines and other machines and in particular to a novel combination pedestal and vacuum system.

2. Description of the Related Art

Grinder wheels with guards are known in U.S. Pat. No. 4,578,907 assigned to the assignee of the present invention. Such grinder wheels produce substantial amounts of dust and particulate matter as grinding occurs and it is desirable to remove such dust and particulate from the vicinity of the grinder so that the operator can clearly see the results of the grinding and also for health reasons to remove such material so that it will not be inhaled the operator.

SUMMARY OF THE INVENTION

It is the object of the present invention to provide a combination pedestal and vacuum system for a grinder or other tools wherein the pedestal is formed with one or more compartments in which a vacuum bag is mounted which is fluidly connected to the guard of a grinder or mounted adjacent a grinding or other tool and wherein a second compartment of the pedestal includes a blower and motor which creates suction in the first compartment and wherein dust and other particulate material is sucked from the vicinity of the grinder into the first compartment and is caught in a vacuum bag which is subjected to suction caused by the motor and blower which is mounted in the second compartment of the pedestal. A sealed door is provided in the wall of the pedestal so that the vacuum bag can be periodically removed and replaced.

In machines which do not have a vacuum hose connection on the guard of the machine the vacuum hose of the invention can be attached adjacent to the working surface of tee grinder or other machines so as to remove the grinding products from the vicinity of the machine.

Other objects, features and advantages of the invention will be readily apparent from the following description and claims when read in view of the drawings in which:

DESCRIPTION OF THE PREFERRED EMBODIMENTS

Figure 1:
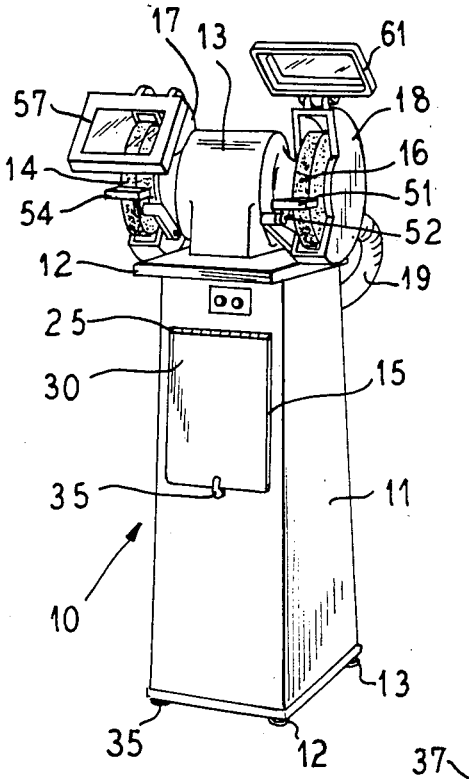
FIG. 1 is a perspective view of the invention.
Figure 2:
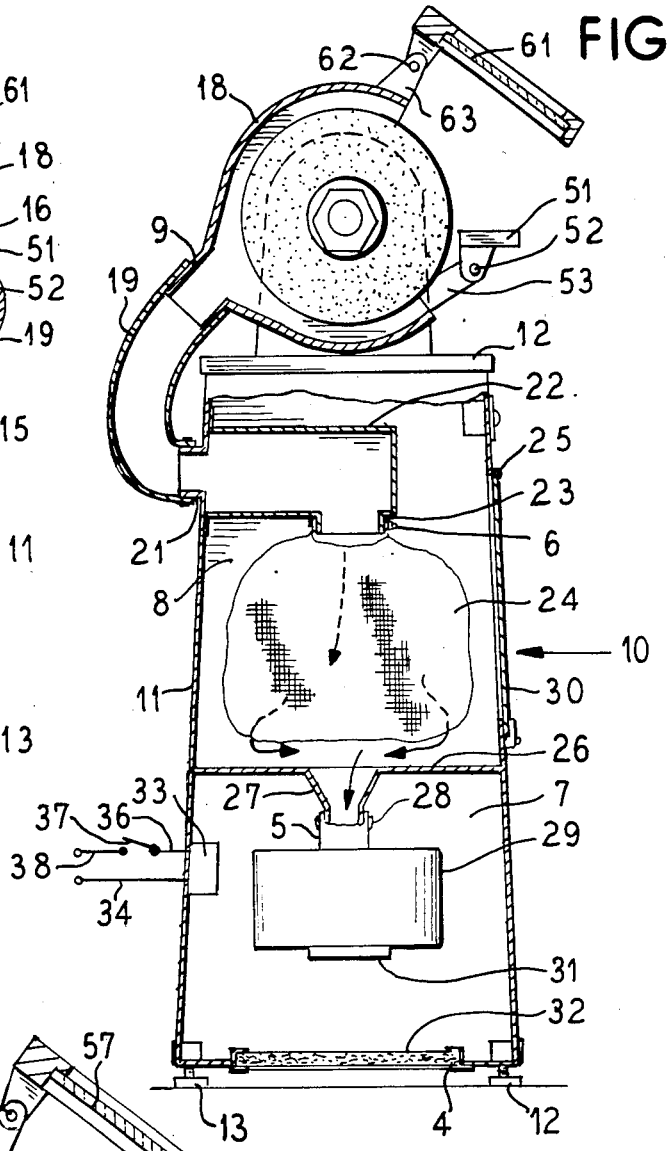
FIG. 2 is a sectional view of the invention.

FIGS. 1 and 2 illustrate the novel combination pedestal and vacuum system for a machine such as a grinder. The combination pedestal and vacuum system 10 includes a generally rectangular stand 11 which has a base 12 upon which a motor 13 is mounted which drives a pair of grinder wheels 14 and 16. Grinders are partially enclosed by suitable guards 17 and 18 of conventional type. Tool rests 51 and 54 are suitably mounted near the wheels 14 and 16. For example, rest 51 is mounted with a mounting pin 52 to a bracket 53. Eye guards 57 and 61 are attached to the wheel guards 17 and 18 as shown for example, in FIG. 2 by pivot pin 62 and a suitable bracket 63 which is connected to the guard 18. As best shown in FIG. 2, the guards 17 and 18 are formed with discharge nozzles 9 to which a suitable flexible conduit 19 can be attached. The flexible conduit 19 is connected to a collar 21 mounted in the pedestal 11 and extends into the walls of a first compartment 8 formed in the top portion of the pedestal 11. A conduit 22 is connected to the collar 21 and has a collar 23 upon which a vacuum bag 24 is detachably connected by suitable holding means 6 which fits around the collar 23. A horizontal partition wall 26 is formed in the inside of the pedestal 11 and divides the compartments 7 and 8 as shown in FIG. 2. An opening 27 is formed in the wall 26 and has a collar 28 which is connected to inlet 5 of a motor and blower 29. The motor and blower 29 has an outlet 31 which ejects the air through a suitable filter means 32 mounted in an opening 4 of the pedestal 11. The pedestal 11 is supported from the floor by a suitable adjustable feet 12, 13, 14 and 35 as illustrated. The junction box 33 is connected to the motor and blower 29 and is mounted on the wall of the pedestal 11 and is connected to power leads 34 and 36. A switch 37 is connected in power lead 36 and when closed, connects lead 36 to lead 38. Leads 34 and 38 are connected to a suitable power source as for example, 110 A.C. voltage.

A door 30 is pivotly connected by hinge 25 to one wall of the pedestal 11 and is locked by a latch 35 and sealed by a gasket 15. The door 30 communicates with the compartment 8 in which the vacuum bag 24 is mounted so that the vacuum bag 24 can be removed and replaced when it becomes filled with materials.

In operation, when the grinding wheels 14 and 16 are operated, the blower and motor 29 will also be energized by closing the switch 37 so that a vacuum is created in the compartment 8 which causes suction through the vacuum bag 24. The passageway 22 to the tube 19 and inlet 9 causes suction of material within the guard 18 into the vacuum bag 24 as illustrated in FIG. 2, for example. It is to be realized that the tube 19 may be Y shaped and have a second leg which connects to a suitable collar on the rear of the guard 17 so that suction will be continuously applied to the guards 17 and 18 when the blower and motor 29 are energized. As the grinding wheels 14 and 16 are used the blower and motor 29 will continuously provide suction and remove the particles and dust from the vicinity of the grinding wheels 14 and 16. When the bag 24 becomes filled with debris, the blower and motor 29 are de-energized and the bag 24 can be changed by opening the door 30 by moving the latch 35 and replacing the bag 24 from the collar 23 and by inserting a new bag on the collar 23. Then the door 30 is closed and the latch 35 is locked and the compartment 8 becomes an air-tight compartment due to the seal 5 surrounding the door 30 so that as the blower and motor 29 are energized air and dust particles will be sucked through the hose 19 into the bag 24. It is seen that the pedestal provides not only a stand for the motor 13 and the grinding wheels 14 and 16 but also provides a container for a vacuum system so as to maintain suction in the guards 17 and 18 to remove dust and other materials from the vicinity of the grinding wheels.

Figure 3:
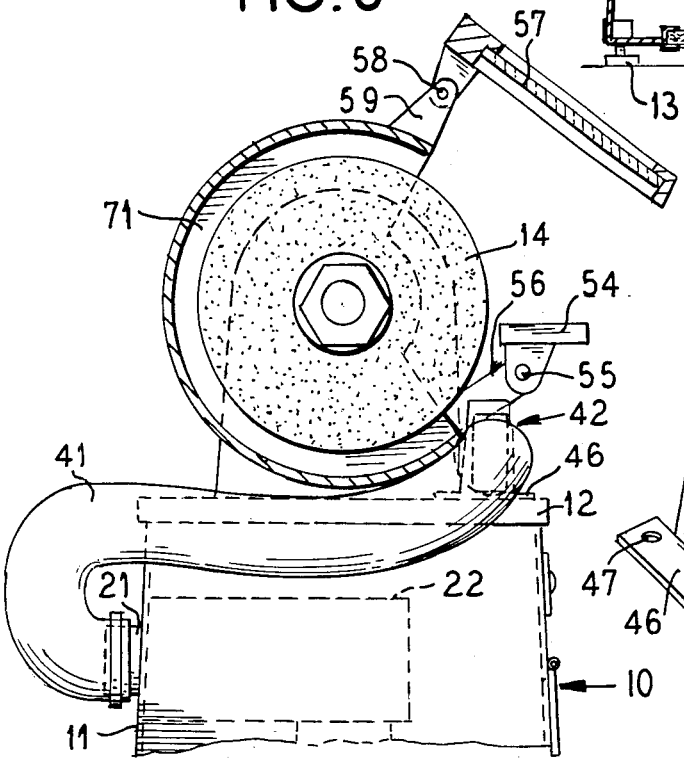
FIG. 3 illustrates a modification of the invention.
Figure 4:
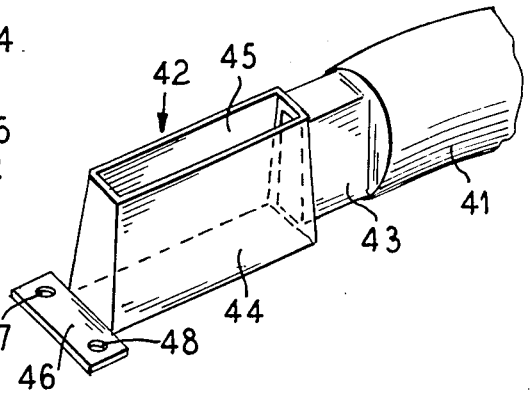
FIG. 4 is a detail of the nozzle of the modification illustrated in FIG. 3.

FIGS. 3 and 4 illustrate a modification of the invention wherein with the machines which have guards that do not have a suction outlet collar 9 such as illustrated in FIG. 2, but are guards 71 such as shown in FIG. 3 which substantially enclose the grinding wheel 14. A flexible conduit 41 can be connected to the collar 21 with a suitable holding means and has a suction attachment 42 illustrated in FIG. 4 which has a portion 43 that connects to the conduit 41 and has an opening 45 which communicates with the conduit 41. The portion 44 of the nozzle 42 has a bracket 46 formed with openings 47 and 48 which can be attached to the stand 12 of the grinder by suitable screws or bolts so as to hold the opening 42 in the vicinity of the grinding wheel 14 so as to provide suction to remove dust and other materials from the grinding wheel 14. A bracket 59 of guard 71 supports a guard 57 by pivot pin 58.

It is seen that the invention comprises a novel pedestal and suction system wherein the pedestal includes a blower and motor mounted in the first compartment and a vacuum bag mounted in the second compartment which communicates with the blower and motor and which is also coupled by suitable conduits to the vicinity of the grinding wheels so as to remove materials in the vicinity of the grinding wheels.

Although the invention has been described with respect to certain preferred embodiments, it is not to be so limited as changes and modifications can be made therein which are within the full intended scope as defined by the appended claims.

We claim as our invention:

1. A combination stand and vacuum cleaning system for a power tool comprising, a stand upon which said power tool is mounted and formed with first and second compartments, a suction conduit extending from said power tool into said first compartment, a vacuum bag mounted over said suction conduit in said first compartment, a motor-blower mounted in said second compartment and with an air inlet in communication with said first compartment so as to create a vacuum therein, and an outlet for said motor-blower mounted in said second compartment, and including a bracket mounted adjacent said power tool and supporting an inlet end of said suction conduit adjacent said power tool.

2. A combination stand and vacuum cleaning system according to claim 1 including a filter mounted in said outlet for said motor-blower.

3. A combination stand and vacuum cleaning system according to claim 1, including an airtight door mounted on said first compartment to allow said vacuum bag to be removed and emptied.

* * * * *